United States Patent [19]

Wilkinson

[11] Patent Number: 4,561,652

[45] Date of Patent: Dec. 31, 1985

[54] EXERCISING DEVICE FOR SIMULATING CLIMBING

[76] Inventor: William T. Wilkinson, P.O. Box 3567, Greenville, Del. 19807

[21] Appl. No.: 388,881

[22] Filed: Jun. 16, 1982

Related U.S. Application Data

[63] Continuation-in-part of Ser. No. 235,419, Feb. 17, 1981, Pat. No. 4,340,218.

[51] Int. Cl.[4] ..... A63B 21/12

[52] U.S. Cl. ..... 272/119; 182/228; 273/DIG. 30; 272/DIG. 4

[58] Field of Search ..... 272/70, 93, 136, 142, 272/DIG. 4; 128/25 R; 182/228; 273/DIG. 30

[56] References Cited

U.S. PATENT DOCUMENTS

| | | | |
|---|---|---|---|
| 2,097,273 | 10/1937 | Feist | 272/93 |
| 2,214,052 | 7/1938 | Good . | |
| 2,241,833 | 5/1941 | Waller | 272/119 |
| 2,524,971 | 10/1950 | Gray . | |
| 3,035,671 | 5/1962 | Sicherman . | |
| 3,112,811 | 12/1963 | Moran | 182/228 X |
| 3,268,031 | 8/1966 | Hampson | 182/228 X |
| 3,528,652 | 9/1970 | Tarbox | 272/119 |
| 3,532,356 | 10/1970 | Lillibridge . | |
| 3,608,256 | 9/1971 | Jefferys | 182/228 X |
| 3,743,283 | 7/1973 | Garrett . | |
| 3,970,302 | 7/1976 | McFee . | |
| 4,239,211 | 12/1980 | Wilkerson | 272/119 |
| 4,316,524 | 2/1982 | Lapeyre . | |
| 4,340,218 | 7/1982 | Wilkinson | 272/70 X |

FOREIGN PATENT DOCUMENTS

| | | | |
|---|---|---|---|
| 0073744 | 9/1982 | European Pat. Off. . | |
| 45140 | 1/1888 | Fed. Rep. of Germany . | |
| 49111 | 4/1889 | Fed. Rep. of Germany . | |
| 523174 | 4/1931 | Fed. Rep. of Germany . | |
| 2243794 | 3/1974 | Fed. Rep. of Germany | 272/135 |
| 2500591 | 1/1975 | Fed. Rep. of Germany . | |
| 1432392 | 2/1966 | France | 272/69 |
| 1463005 | 11/1966 | France . | |
| 791081 | 12/1954 | United Kingdom . | |
| 1333291 | 10/1973 | United Kingdom . | |
| 2010101 | 6/1979 | United Kingdom . | |
| 1552415 | 9/1979 | United Kingdom . | |
| 1568081 | 5/1980 | United Kingdom | 272/119 |
| 2076664 | 12/1981 | United Kingdom | 272/69 |

*Primary Examiner*—Richard J. Apley
*Assistant Examiner*—William R. Browne
*Attorney, Agent, or Firm*—Connolly and Hutz

[57] ABSTRACT

An exercising device for simulating climbing includes a frame having a vertically adjustably mounted horizontal platform for varying the height of the platform. Adjustable resisting elements in the form of a sleeve having removable weights are mounted on the user to vary the effort required by the user for stepping up onto the platform.

3 Claims, 7 Drawing Figures

EXERCISING DEVICE FOR SIMULATING CLIMBING

CROSS-REFERENCE TO RELATED APPLICATION

This application is a continuation-in-part of copending application Ser. No. 235,419, filed Feb. 17, 1981 now U.S. Pat. No. 4,340,218 which issued July 20, 1982.

BACKGROUND OF INVENTION

Parent application Ser. No. 235,419 discloses a resilient type exerciser for simulating climbing. In the preferred embodiment disclosed therein, an adjustable step is provided which operates in connection with adjustable resisting means to vary the effort required by the user climbing the step. Such device overcomes various disadvantages with natural climbing by providing facilities which are readily available even for indoor purposes. In the preferred form disclosed in the parent application, the resisting means is in the form of resilient members such as springs which are attached to a base member the distance of a normal stride away from the step and which are attached at the other end to the user.

Summary Of Invention

An object of this invention is to provide a variation of the exercising device described in the parent application.

A further object of this invention is to provide such a variation which utilizes a more convenient form of resisting means and a more simplified form of step structure.

In accordance with this invention, the resisting means is in the form of a sleeve having at least one exposed pocket section with a weight removably inserted therein so as to vary the effort required by the user in climbing the step.

The sleeve may have a pair of free ends between which are located a plurality of such pockets so that any number of different weights may be inserted in different pockets and the free ends could be secured together around the user.

The step itself may take the form of a frame having a base member on which is mounted any selected number of spacer bars with a horizontal platform therein being mounted on the spacer bars. The frame may include vertical angle iron posts which would serve to properly locate the base, the spacer bars and the platform. An upwardly extending post may be secured to one of the angle iron members to act as a convenient member which the user may grasp while climbing up and down the step.

THE DRAWINGS

DETAILED DESCRIPTION

Figure 1:
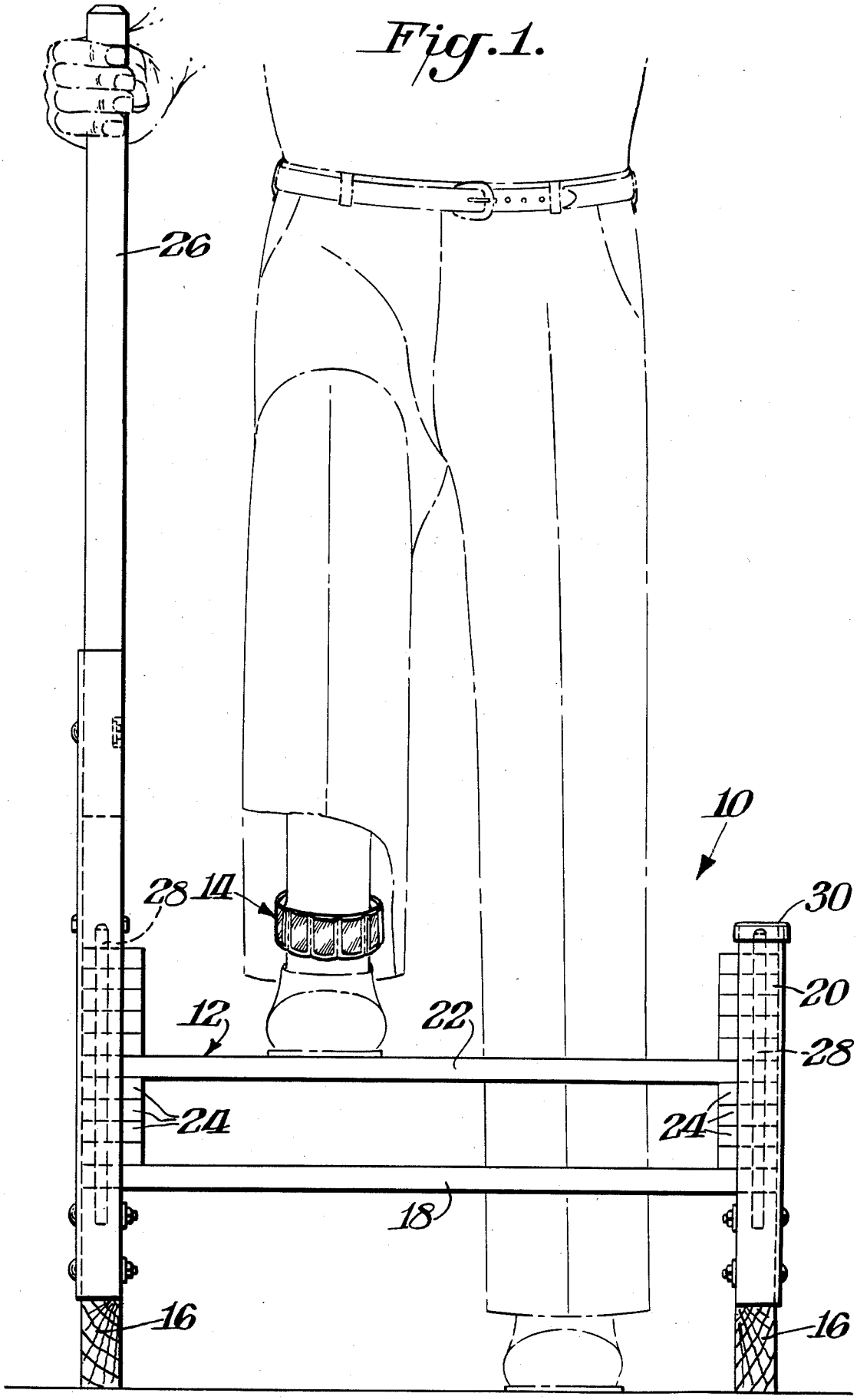
FIG. 1 is a front elevation view of the exercising device in accordance with this invention.

FIG. 1 shows an exercising device 10 in accordance with this invention used for simulating climbing. In general exercising device 10 includes an adjustable step 12 and adjustable resisting means 14. It is to be understood that resisting means 14 may, for example, be used with the type of step which will be described hereinafter or with any other step including that disclosed in parent application Ser. No. 235,419. Similarly, step 12 may be used with any suitable resisting means such as resisting means 14 or with the type of resisting means as described in parent application Ser. No. 235,419.

As best shown in FIGS. 1–4, step 12 includes a frame which comprises side support means in the form of a pair of tee members 16, 16 which may be made from any suitable material such as metal or wood. A base member 18 is secured to and spans tee members 16, 16. For example, where base member 18 and tee members 16 are made of wood, base member 18 may be attached by nailing, screwing or other suitable fastening means. Mounted on the upward shoulder or ledge of each tee member 16 is an angle shaped post 20 having an L-shaped cross-section. In this manner, four such posts are provided with a pair of posts being secured to each tee member in mirror-image relationship to each other. One of the posts is made substantially longer than the remaining three posts for purposes which will be described hereinafter. Posts 20 may be secured to tee members or side supports 16 in any suitable manner such as by bolts or the like. Posts 20 are preferably made of angle irons which provide a sturdy support.

The step portion of step 12 is provided as a platform 22 which may be similar to base member 18 except that it is vertically adjustably mounted rather than being mounted at a fixed elevation as is base member 18. The vertical adjustability of platform 22 is achieved by a plurality of spacer bars 24 dimensioned to fit generally snugly against the inner faces of angle posts 20. In use the user would select the desired number of spacer bars to be placed at each end of base member 18 until the desired elevation is achieved whereupon platform 22 would then be placed on spacer bars 24. It is noted that FIG. 1 illustrates additional spacer bars placed on top of platform 22. This provision of spacer bars on top of platform 22, however, is not necessary for simulating climbing but rather is shown to illustrate that additional spacer bars are provided and those which are not being used may be stored in the manner shown in FIG. 1.

Figure 2:
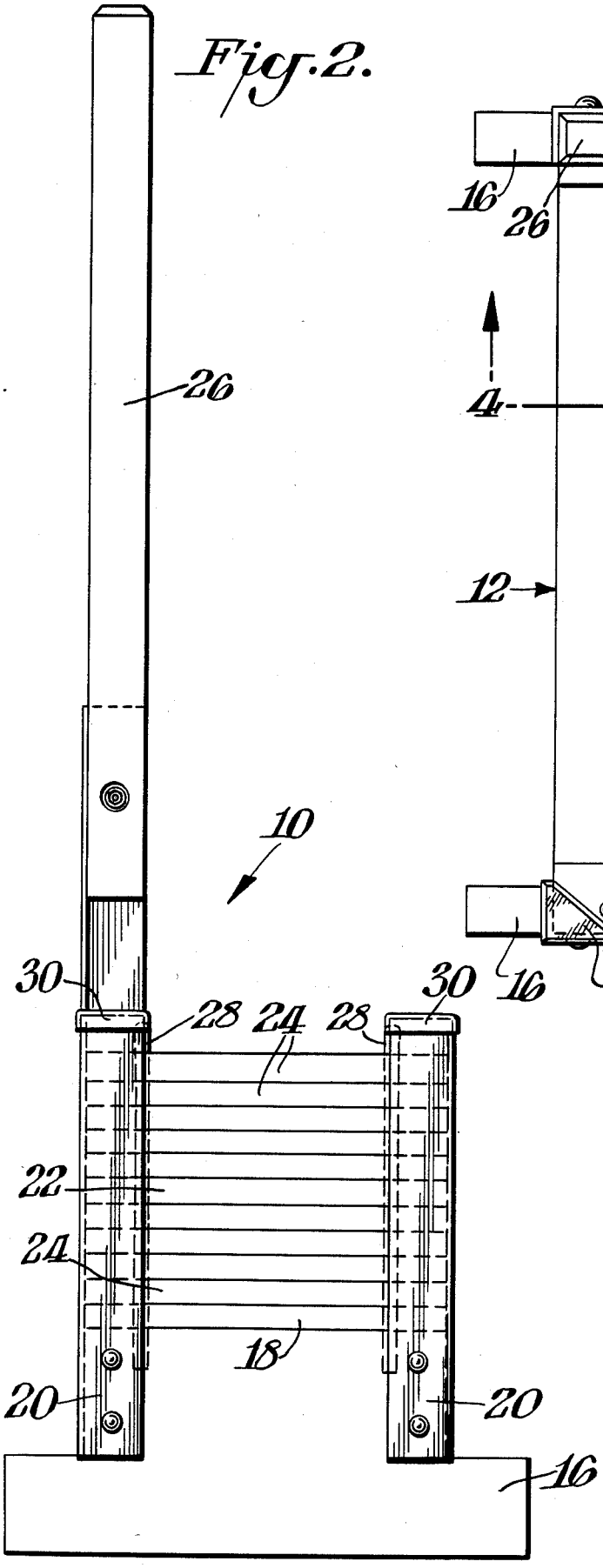
FIG. 2 is a side elevation view of the exercising device shown in FIG. 1.
Figure 3:
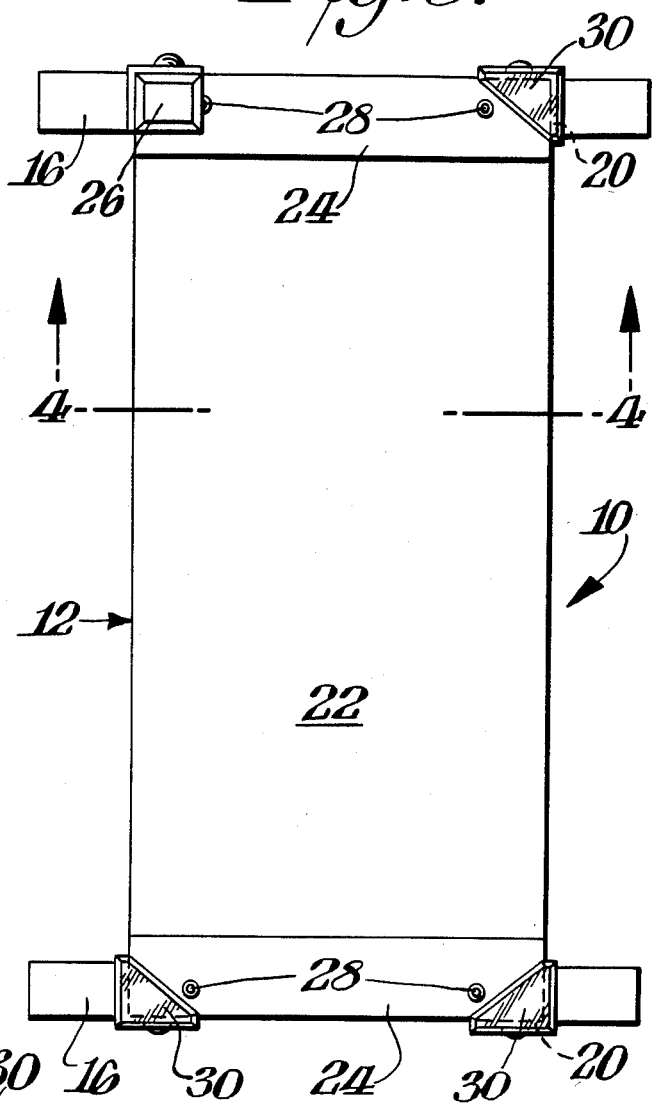
FIG. 3 is a top plan view of the exercising device shown in FIGS. 2–3.
Figure 4:
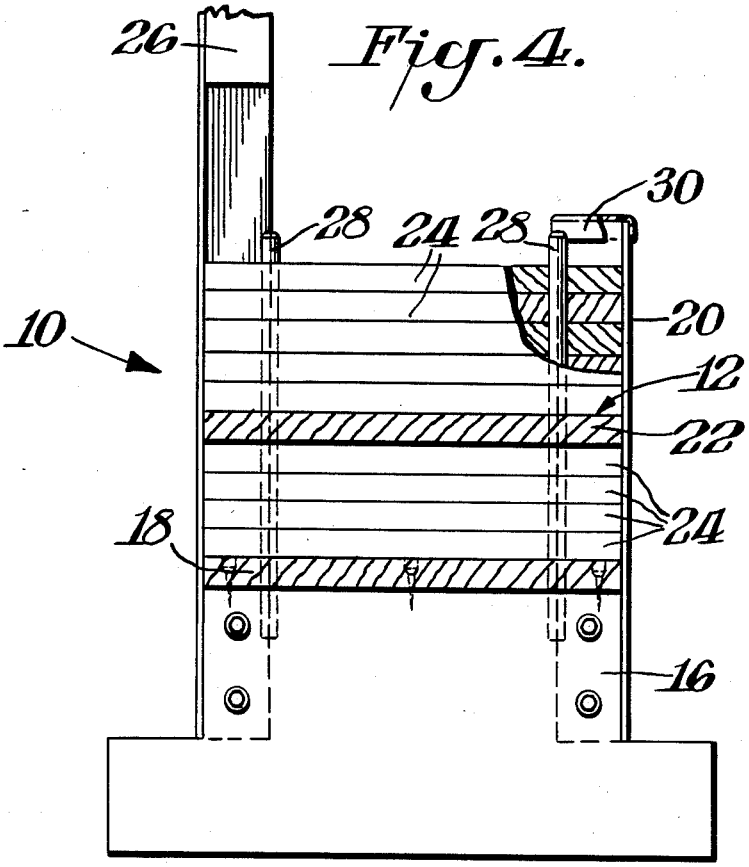
FIG. 4 is a cross-sectional view taken through FIG. 3 along the line 4—4.

FIGS. 1 and 2 best illustrate the provision of a hand support post 26 secured to the angle member 20 which is of greater height than the remaining angle members. As shown in FIGS. 1 and 2, hand support 26 terminates a substantial distance above the remaining angle members 20 so as not to interfere with the placement of the spacer bars on the device. Hand support post 26 would be secured to a corner remote from the user so that in use the user could grasp hand support 26 as the user steps up onto platform 22 toward hand support 26.

FIGS. 1–4 illustrate a form of this invention wherein any suitable number of upwardly extending rods 28 may be secured to side supports 16. Where such rods are used, the rods would extend through base member 18 and project upwardly to about the same level as angle posts 20. Suitable holes would be provided in spacer bars 24 and in platform 22 so that the spacer bars and platform can slide down rods 28. In this manner, once spacer bars 24 and platform 22 are positioned, rods 28 will eliminate any tendency of these members to slide inwardly. Thus rods 28 provide an advantageous means of holding the spacer bars and platform in place during use of device 10.

Figure 5:
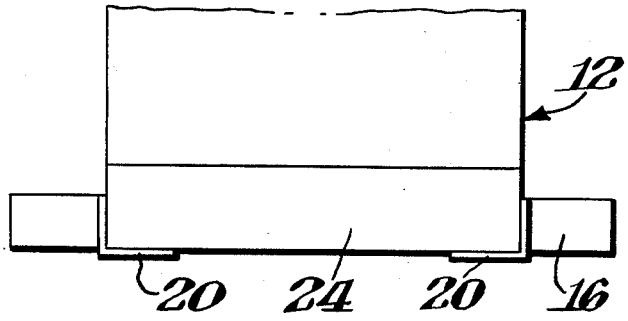
FIG. 5 is a top plan view similar to FIG. 3 showing a portion of a modified form of exercising device.

Any other suitable means such as straps, clamps or the like may also be used to hold the spacer bar and platform in place. FIG. 5 illustrates a variation where such locking means as rods, clamps or bars are completely eliminated and spacer bars and platform would be held in place due to close dimensioning of these members or simply from the weight of the members themselves.

Where metal posts are used for members 20, protective means such as plastic caps 30 may be snapped onto the upper ends of post 20 so that the sharp corners at the upper ends of angle post 20 would be shielded.

Figure 6:
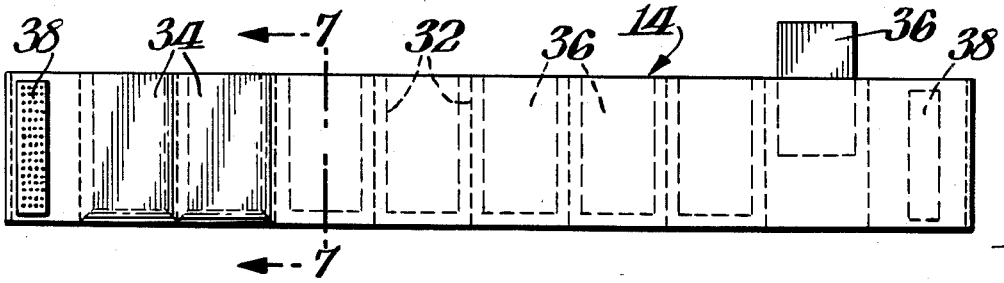
FIG. 6 is a front elevation view of the adjustable resisting means shown in FIG. 1.
Figure 7:
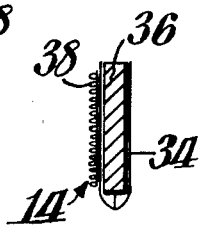
FIG. 7 is a cross-sectional view taken through FIG. 6 along the line 7—7.

FIGS. 1 and 6–7 show a preferred form of adjustable resisting means 14. As indicated therein, the adjustable resisting means 14 is in the form of a sleeve which is made by juxtaposing two rectangular members which are then secured together along the bottom and both sides thereof to result in an exposed top portion and a pair of free ends. A plurality of dividers 32 are formed at spaced intervals in sleeve or resisting means 14. Dividers may, for example, be formed by simply sewing portions of the flexible members together so as to form a plurality of pockets 34 which are exposed at their upper ends. Weights 36 may be removably inserted into any selected number of pockets to thereby adjust the load of resisting means 14. For example, each weight 36 may be a one pound slug, and the total load would be determined by the number of pockets filled with such weights. Velcro formations 38 are provided at the free ends of sleeve 14 to conveniently and adjustably attach sleeve 14 to the user.

In the illustrated form of this invention, sleeve 14 is wrapped around the ankle of the user. It is to be understood, however, that the concepts of this invention may be practiced by securing the sleeve to any suitable part of the body such as the wrist or waist. Similarly, other forms of fastening means may be used, although Velcro is particularly convenient.

The provision of sleeve 14 permits the user to have a progressive adjustable load so as to progressively increase the resisting force during the simulated climbing thereby having progressively more difficult exercises as part of the user's program.

Step 12 and resisting means 14 may take any suitable form and may be made from any suitable materials and dimensions. For example, platform 22 may be about 11 inches by 24 inches and $\frac{3}{4}$ inch thick. Spacer bars 24 may be 2 inches by 11 inches and $\frac{3}{4}$ inch thick. Angle posts 20 may be formed by a pair of legs 2 inches by $1\frac{3}{4}$ inch long, respectively. Angle posts 20 may terminate about 16 inches above the lower surface of side support 16. Hand support 26 may be about $1\frac{3}{4}$ inches in cross section and $28\frac{1}{4}$ inches long while terminating at its upper end about 48 inches above the lower surface of side support 16. Side support 16 in turn may be about $16\frac{1}{2}$ inches in length at its lower surface and 11 inches in length at its upper surface. Sleeve 14 would vary in dimension in accordance with the particular part of the body on which it is to be mounted. As an ankle wrap, for example, sleeve 14 could be about $11\frac{1}{2}$ inches long in the area of its pockets with each pocketless free end 2 inches long so as to form a composite length of about $15\frac{1}{2}$ inches. Where used for the waist or wrist, the length would be longer or shorter, respectively.

As previously indicated, the preferred fastening means for the sleeve is Velcro. Velcro is particularly desirable in contrast to belts, buckles, laces or the like because of its quick and easy manner of application. The types of weighted ankle sleeves or the like which are known in the prior art for use by, for example, joggers, could not readily use Velcro as the fastening means because unlike simulated climbing, such forms of exercise impart motions which would hamper the use of Velcro as an effective fastening means.

Exercising device 10 is particularly advantageous for accomplishing the results of the device described in parent application Ser. No. 235,419. Thus the device is particularly advantageous for indoor use while also being sufficiently portable to take on trips. The portability may be enhanced by the components of device 10 being made in a knock-down form which may be easily reassembled by the simple manipulation of a small number of screws, nuts and bolts.

What is claimed is:

1. An exercising device for simulating the action of climbing comprising a frame, a step including a platform, vertical adjusting means on said frame for selectively mounting said platform to said frame at one of a plurality of different selected positions whereby the height of said platform may be varied in accordance with the particular user thereof, said vertical adjusting means permitting said entire platform to be selectively movable to said plurality of different positions to permit the user to select an appropriate excercising program said platform being the sole adjustable step secured to said frame, adjustable resisting means comprising a sleeve having at least one exposed pocket section, a weight removably mounted in said sleeve whereby the force of said resisting means may be varied in accordance with the particular user, and means for detachably securing said sleeve to the user whereby effort required by the user for stepping up and said step may be varied in accordance with the height of said platform and the amount of weight in said sleeve, said frame comprising a pair of spaced side support means, a base member connected to and spanning said side support means, spacer means for being mounted on said base member for supporting said platform, each of said side support means comprising a pair of angle posts having an L-shaped cross-section with a pair of legs disposed in mirror-image relationship, a vertical hand support post being mounted against the legs of one of said angle posts and extends upwardly above said side support means, and said spacer means comprising a plurality of bars with each bar spanning and in contact with a respective pair of angle posts.

2. The device of claim 1 wherein said sleeve comprises a pair of juxtaposed flexible rectangular members secured along three sides thereof with the fourth side thereof being open, said sleeve having a pair of free ends, and a plurality of spaced vertical dividers extending from said open side to form a plurality of pockets for selectively receiving weights therein.

3. The device of claim 2 wherein adjustable fastening means are on said free ends of said sleeve, and said fastening means being Velcro.

* * * * *